US008069866B2

(12) United States Patent
Moore et al.

(10) Patent No.: US 8,069,866 B2
(45) Date of Patent: Dec. 6, 2011

(54) APPARATUS AND METHOD FOR CLEANING BEVERAGE LINES

(75) Inventors: Gregory Moore, Kells (IE); Clint Donnellan, Kells (IE)

(73) Assignee: Gregory Moore, Kells (IE)

( * ) Notice: Subject to any disclaimer, the term of this patent is extended or adjusted under 35 U.S.C. 154(b) by 1108 days.

(21) Appl. No.: 10/592,696

(22) PCT Filed: Mar. 10, 2005

(86) PCT No.: PCT/IE2005/000021

§ 371 (c)(1),
(2), (4) Date: Jan. 29, 2007

(87) PCT Pub. No.: WO2005/087397

PCT Pub. Date: Sep. 22, 2005

(65) Prior Publication Data

US 2007/0204884 A1 Sep. 6, 2007

(30) Foreign Application Priority Data

Mar. 12, 2004 (IE) ..... S2004/0152

(51) Int. Cl.
*B08B 3/08* (2006.01)

(52) U.S. Cl. ..... 134/99.2; 134/100.1; 134/95.1; 134/169 C

(58) Field of Classification Search ..... 134/94.1, 134/95.1, 100.1, 169 C, 99.2
See application file for complete search history.

(56) References Cited

U.S. PATENT DOCUMENTS 4,815,190 A * 3/1989 Haba et al. ..... 29/430
5,601,101 A * 2/1997 Grapes et al. ..... 134/56 R
6,357,454 B1 3/2002 Yokota et al.
6,557,570 B1 * 5/2003 Gierbolini et al. ..... 134/111

FOREIGN PATENT DOCUMENTS

DE 3642611 * 12/1986
DE 3920046 * 6/1989
DE 4313292 * 4/1993

(Continued)

OTHER PUBLICATIONS

Search Report with Written Opinion, PCT/IE2005/000021.

(Continued)

*Primary Examiner* — Michael Barr
*Assistant Examiner* — Saeed T Chaudhry
(74) *Attorney, Agent, or Firm* — Christopher John Rudy

(57) ABSTRACT

Conduit can connect a beverage line in fluid communication with a supply of first fluid. A pump operates to allow a second fluid to enter the conduit in a predetermined proportion relative to the first fluid. A primary first fluid control means and a secondary first fluid control means are selectively and independently movable between respective open positions in which the first fluid can flow into the conduit and respective closed positions in which flow of the first fluid into the conduit is substantially prevented. In use, the primary first fluid control means is in the open position, and the secondary first fluid control means selectively alternates between the open position and the closed position so as to create a pulsed secondary flow of the first fluid into the conduit for enhanced cleaning.

16 Claims, 4 Drawing Sheets

FOREIGN PATENT DOCUMENTS

Figure 1A:
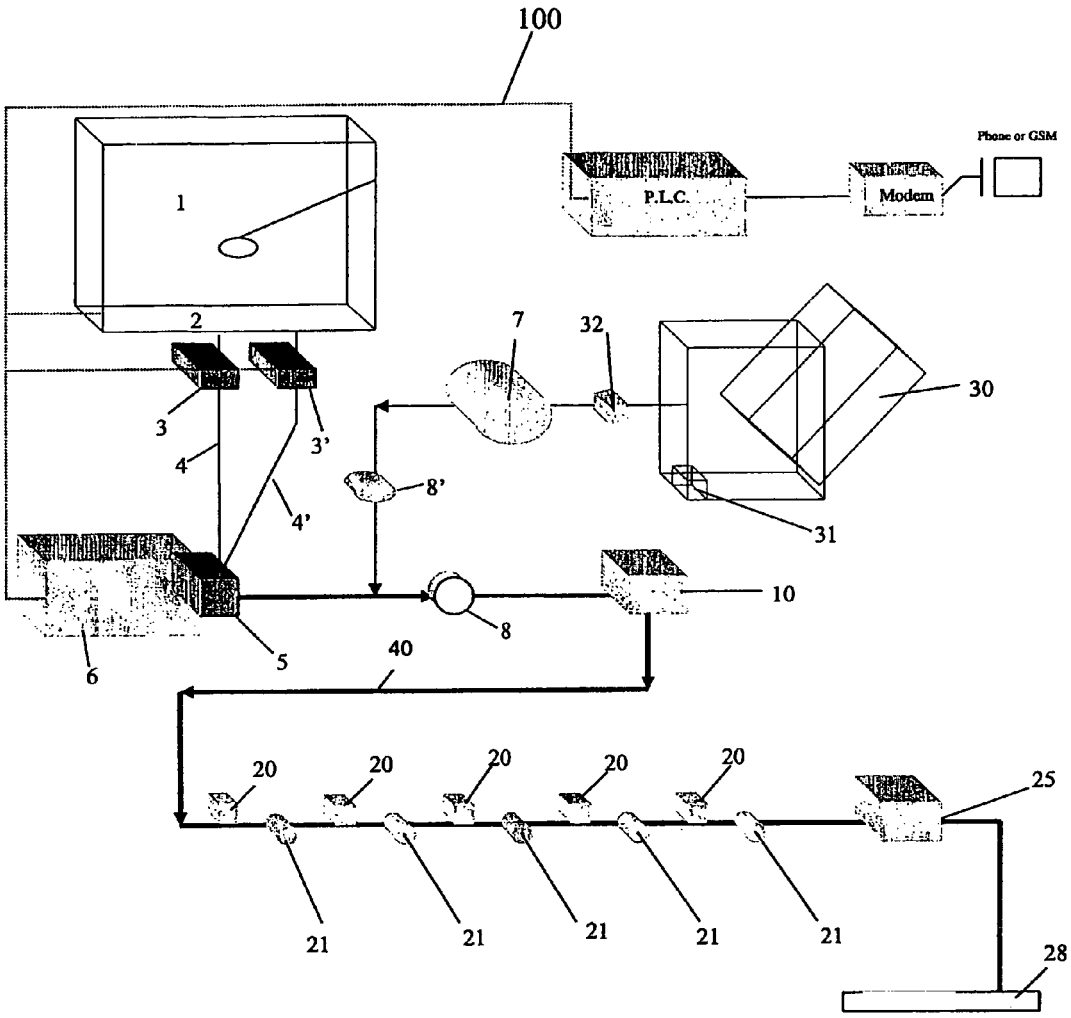

| | | | |
|---|---|---|---|
| EP | 047214 | | 5/1992 |
| FR | 2354829 | | 1/1978 |
| FR | 2642997 | | 8/1990 |
| GB | 1196912 | * | 7/1970 |
| WO | WO 9512543 | * | 5/1995 |
| WO | WO 0053346 | | 9/2000 |
| WO | WO 2005/087397 | | 9/2005 |

OTHER PUBLICATIONS

Letter of Jan. 17, 2006 with Demand and amendments in PCT/IE2005/000021.
Written Opinion of IPEA in PCT/IE2005/000021.
Preliminary Report on Patentability with Notice in PCT/IE2005/000021.

* cited by examiner

APPARATUS AND METHOD FOR CLEANING BEVERAGE LINES

This is a U.S. National Stage filing of international patent application No. PCT/IE2005/000021 filed on Mar. 10, 2005 A.D., which claims priority benefit of Irish patent application No. S2004/0152 filed on Mar. 12, 2004 A.D. The specifications with drawings of those applications are incorporated herein by reference in their entireties.

FIELD OF THE INVENTION

The present invention relates to an apparatus and method for cleaning beverage lines and, in particular, for cleaning beer lines such as those used in public houses and other licensed premises. In the context of this specification, the word, "beer," is to be construed as including ales, lagers, porters and stouts.

BACKGROUND TO THE INVENTION

All beer lines in licensed premises for the purpose of dispensing beer need to be cleaned on a regular basis (one cleaning per week recommended) with a dilute solution of sodium hydroxide. If these lines are not cleaned regularly, yeast will form on the inner walls of the lines, and a build-up of yeast will occur. The result of this build-up of yeast will be that the beer dispensed will be of poor quality and will have a sour taste.

The current method of cleaning beer lines involves the removal of the connection of the pipe from the keg or storage container, and attaching the beer line connection to a plastic vessel which contains a solution of water and a cleaning agent. Gas pressure from the beer gas cylinders, accessible through the beer line connection, is used to force the cleaning solution through the beer line when the tap at the main bar is released. The beer which is already in the line at commencement of the cleaning process is disposed of, up until the point that the cleaning solution becomes visible. At this point, the tap is closed, and a "soak" period, during which the cleaning solution is in contact with the inner wall of the beer lines, is used to break down the sediment and yeast. After this "soak" period, the plastic vessel holding the cleaning solution must be emptied, washed, then filled with water, and then re-attached to the beer line connection, and the tap is re-opened. At the point where the cleaning solution has been removed from the beer line, the tap must be closed again, and the beer line connection must then be re-attached to the keg. The tap must be re-opened, and the water must be removed from the line until the beer returns. Usually as part of this, a couple of pints of beer are also disposed of to ensure that the cleaning solution has been completely removed from the beer lines.

That known method suffers from the disadvantage that the cleaning solution (usually 1% sodium hydroxide solution) has to be made up manually, and this process is prone to error. The quantity of water used for rinsing may not be adequate, and hence the beer line may still have traces of cleaning agent. The line may also have traces of cleaning agent after the final rinse if the cleaning bucket was not properly rinsed free of the sodium hydroxide solution before it was filled with the final rinse fresh water. The container holding the concentrated sodium hydroxide solution has to be handled manually and the solution measured out in a measuring cup. This measuring process is prone to spills, and the sodium hydroxide solution often comes into contact with the operator's skin since, in practice, safety gloves and goggles are seldom used. Thus, the known method of cleaning beer lines described above leaves significant scope for human error because the cleaning solution mixing and "soak" periods are not precise enough to ensure that proper cleaning has taken place or to ensure that the cleaning agent has been removed before beer is again used in the cleaned line.

Other art is known such as reported from the parent international case. See, e.g., international publication No. WO 2005/087397 A1.

Thus, French patent specification No. FR 2 354 829 discloses a device for the automatic cleaning of piping systems to be connected to a beverage reservoir and installations connected to these systems. The device disclosed in that French specification comprises at least one unit comprising a portion conveying water and an electrical portion which is separate from the portion conveying water. The portion conveying water is composed of a piping system that is divided into at least two parts that can be closed individually by first and second valves and then joined together again. One end of the piping system is connected via a non-return valve to a feed system which is the main water supply, and its other end is connected to a branch part provided with one or more fittings, each fitting being closable. The piping system of an installation to be cleaned can be connected to each branch part; the discharge pipe of a metering pump is connected to at least one of the branches of the portion conveying water, downstream of the valve that controls the closure of this branch; and the branch comprises a second valve downstream of the delivery point of the metering pump, while the suction pipe can be connected to a receptacle of concentrated detergent. The valves and the metering pump can be controlled electrically by the electrical portion, which is connectable to a power source. Further there comprises a program selection knob, a push-button switch, an electrical source for driving the metering pump, and a timer.

European patent specification No. EP 0 487 214 discloses a beverage dispensing system cleaning apparatus. It includes means for selectively supplying cleaning fluid to an inlet of the system, selectively operable valve means connected with the outlet of the system, and control means to admit cleaning fluid to the system and to selectively operate the valve means to effect agitation of the cleaning fluid in the system.

Compare, DE 3920046; DE 4313292; FR 2642997; GB 1196912; WO 9512543 and WO 0053346.

Also, beer lines are of different length and can have quite substantial climbs from the cellar to the actual bar counter at which the beer is dispensed to a consumer. In some instances, a licensed premises can also have varying lines to different bars or to cold rooms where the beer is held.

SOME OBJECTS OF THE INVENTION

It is an object (aim) of the present invention to provide a method and apparatus for cleaning beverage lines, which alleviates aforementioned problems, and which greatly increases the accuracy and quality of the cleaning process, while also addressing the time required to achieve clean beer lines.

It is a further aim of the present invention to automate the cleaning of beer lines while taking the differences of lengths and climbs of the lines as well as varying lines to different beers or cold rooms into account.

It is also an aim of the present invention to be able to easily change cleaning requirements in situ as part of the installation of the apparatus in order to minimize the wastage of water and cleaning fluid while ensuring proper cleaning of the beer lines.

One or more these aims is/are satisfied by the present invention.

A FULL DISCLOSURE OF THE INVENTION

Accordingly, in a first aspect, the present invention provides an apparatus for cleaning a beverage line comprising:

(a) a conduit for connecting the beverage line in fluid communication with a supply of a first fluid; and a connector means for connecting the beverage line to the conduit;

(b) at least one orifice opening in the conduit for connection via a fluid line to a supply of a second fluid;

(c) pump means operable to allow the second fluid to enter the conduit in a predetermined proportion relative to the first fluid;

(d) means for closing a connection between the orifice in the conduit and the supply of the second fluid; and (e) a primary first fluid control means and a secondary first fluid control means, operable for controlling the flow of the first fluid into the conduit, the primary and secondary first fluid control means being selectively and independently movable between respective open positions in which the first fluid can flow into the conduit and respective closed positions in which flow of the first fluid into the conduit is prevented, characterized in that the apparatus comprises means for creating a pulsed secondary flow of first fluid into the conduit, said means for creating a pulsed secondary flow of first fluid into the conduit comprising means for selectively moving the secondary first fluid control means alternately between the open position and the closed position, with the primary first fluid control means in the open position providing a primary flow of first fluid.

Conveniently, the first and second fluid control means respectively comprise first and second solenoid valves. Thus, the apparatus and method provide means for creating a pulsing cleaning action in the lines to help discharge yeast and sediment. This unique pulsing action is created by opening and closing the second solenoid valve, i.e., a secondary first fluid control means, which helps loosen and flush sediment and yeast from the beer line. This pulsing motion is created in the fluid being pumped by a restriction provided by the bore size of the pipe carrying water from the water tank via the first solenoid valve, to the primary pump and then the cyclical repeated opening and subsequent closing of the second solenoid valve. This pulsing action greatly enhances the cleaning of the line.

Preferably, the apparatus also includes a first pump means for causing flow of the first fluid into the conduit, and the pump means referred to above is a second pump means for causing flow of the second fluid into the conduit, with the second pump means provided on a fluid line located at the high pressure output side of the first pump means.

In a second aspect, the present invention provides an apparatus for cleaning a beverage line comprising:

(a) a conduit for connecting the beverage line in fluid communication with a supply of a first fluid; and a connector means for connecting the beverage line to the conduit;

(b) at least one orifice opening in the conduit for connection via a fluid line to a supply of a second fluid;

(c) pump means operable to allow the second fluid to enter the conduit in a predetermined proportion relative to the first fluid;

(d) means for closing a connection between the orifice in the conduit and the supply of the second fluid; and (e) a first pump means for causing flow of the first fluid into the conduit and a second pump means for causing flow of the second fluid into the conduit, the second pump means being provided on a fluid line located at the high pressure output side of the first pump means.

Preferably, the apparatus also includes a primary first fluid control means and a secondary first fluid control means, operable for controlling the flow of the first fluid into the conduit, the primary and secondary first fluid control means being selectively and independently movable between respective open positions in which the first fluid can flow into the conduit and the respective closed positions in which flow of first fluid into the conduit is substantially prevented, whereby, in use, the primary first fluid control means is in the open position and the secondary first fluid control means selectively alternates between the open position and the closed position so as to create a pulsed secondary flow of first fluid into the conduit for enhanced cleaning.

Preferably, the first fluid and second fluid are both liquid, wherein the first fluid is water and the second fluid is a cleaning agent which is in liquid form.

Conveniently, the first pump means for causing flow of the first fluid comprises a primary pump for pumping the first fluid (water) from the water supply (water tank reservoir) into the conduit, and the second pump means for causing flow of the second fluid (cleaning agent) comprises a secondary pump which is ideally a peristaltic pump.

The conduit is conveniently the ring main.

The means for closing the connection between the orifice and the supply of the second fluid can comprise a non-return valve provided on the fluid line connecting the conduit to the supply of the second fluid.

Conveniently, the apparatus also includes means for opening and closing a connection between the conduit and the beverage line whereby the conduit can be flushed by the first fluid, free of the second fluid, selectively with or without the first fluid flushing the beverage line.

Thus, the present invention provides a fully configurable cleaning system for usage on beverage supply lines and, in particular, on beer lines. Depending on the concentration and amount of cleaning agent required, the apparatus of the invention can alter the mix rates of water and cleaning agent.

Conveniently, the timings and mixture rates are fully configurable, depending on the installation requirements. This is to allow savings on time needed per cycle and to prevent water and detergent wastage. This is due, in part, to the use of a variable peristaltic pump which can mix the detergent and water at whatever rate is needed for a particular beer line. Advantageously, the apparatus of the invention includes a generally L-shaped cleaning fluid introduction device which allows introduction of the cleaning fluid at both the input to the main pump as well as the output of the main pump where there is high pressure in the line. This generally L-shaped introduction device has the advantage of allowing the introduction of acidic, alkaline or abrasive cleaning agents without shortening the expected working life of the pump. This generally L-shaped introduction device is preferably manufactured from stainless steel.

The apparatus of this invention also can include a fully configurable reporting system with built-in modem for use with conventional telephone lines and GSM mobile systems.

Preferably, the apparatus of the invention comprises a "tag" identification system which can exclude pre-determined beer lines to be washed and also report remotely to a central resource on cleaning progress and frequency of cleaning. For installations of less than ten lines, a "Reid" tagging system is to be used, but, for larger premises, a "Radio Frequency Data Tagging" (RFDT) system which also incorporates the use of a personal computer (PC) is preferably used.

The apparatus conveniently also can include a "pH gravity flow meter," which identifies the detergent and controls the mix rate or cleaning cycle required so as to allow maximum flexibility for different cleaning requirements.

Advantageously, the apparatus also comprises a tiltable cleaning fluid storage device, which has the advantage that is minimizes splashes which otherwise may occur while the cleaning fluid container is being replaced, and which also holds the container safely within the storage device so as to avoid accidents. Thus, the invention overcomes the problem of handling of the cleaning fluid, which can be dangerous, and provides a means of storing and safely installing/removing the container of cleaning agent.

This detergent storage device also can include a spring-loaded level indicator (weight sensor) to prevent operation of the apparatus if the container of cleaning agent is empty or the level is too low.

To allow for fluctuating water supplies and low pressure, a water storage tank can be included in the apparatus to ensure that the predetermined mixing rates of water with the cleaning fluid are achieved.

The apparatus and method of the invention have the advantage of speeding up the cleaning time associated with the known manual operation for cleaning beer lines. Depending on the length of the beer line and also the number of lines being cleaned simultaneously, the degree of improvement can be huge. Thus, the apparatus and method of the invention have the advantage of facilitating more frequent cleaning of the beer lines. The apparatus invention saves water, detergent and power over other methods available by being preset with a wash cycle to suit the particular needs of the licensed premises in which the apparatus is installed. The longer the beer lines are, and the more lines there are in need of washing, the longer is the cycle. Each cycle includes a clean water wash, a detergent wash, and then a "soak" period and rinse.

The apparatus and method of the invention also can include means to allow the beer in the line at the time of wash to be used or sold during a dispense cycle so as to minimize costs.

The apparatus of the invention can identify individual lines when these lines are connected to the conduit (ring main) so as to exclude lines from being used with cleaning solution and to allow reporting facilities which include a modem to enable remote dial-up and information-sending to a central resource.

Advantageously, the installer has the option of mixing the cleaning fluid downstream after the main water pump so as to maximize the potential life cycle of the primary pump by using a generally L-shaped introduction device (pipe).

The apparatus and method of the invention thus reduce the wastage of beer as well as water and cleaning agent (cleaning fluid).

The operation and design of the apparatus and method is very simple and easily understood. They also can incorporate back-lit and climate resistant switchgear because most cellars are hostile to electrical equipment.

In a third aspect, the present invention also provides a method of cleaning a beverage line comprising:

(a) providing a flow of a first fluid, such as water, through a conduit, at least one orifice opening into the conduit such that a second fluid may be combined with the first fluid at a specified flow rate relative to the rate of flow of the first fluid, to provide a flow of a solution of the second fluid in the first fluid at a predetermined concentration;

(b) supplying the flow of the solution through the beverage line;

(c) allowing such solution to remain static in the beverage line for a predetermined time;

(d) agitating such solution in the beverage line at predetermined intervals;

(e) operating a primary first fluid control means and a secondary first fluid control means, for controlling the flow of the first fluid into the conduit, the primary and secondary first fluid control means being selectively and independently movable between respective open positions in which first fluid can flow into the conduit and respective closed positions in which flow of first fluid into the conduit is prevented, whereby, in use the primary first fluid control means selectively alternates between open position and the closed position so as to create a pulsing secondary flow of first fluid into the conduit for enhanced cleaning;

(f) providing a flow of the first fluid through the conduit and the beverage line to flush the solution from the beverage line.

In a fourth aspect, the present invention further provides a method of cleaning a beverage line comprising:

(a) providing a flow of a first fluid, such as water, through a conduit, at least one orifice opening into the conduit such that a second fluid may be combined with the first fluid at a specified flow rate relative to the rate of flow of the first fluid, to provide a flow of a solution of the second fluid in the first fluid at a predetermined concentration;

(b) supplying the flow of the solution through the beverage line;

(c) allowing such solution to remain static in the beverage line for a predetermined time;

(d) agitating such solution in the beverage line at predetermined intervals;

(e) operating a first pump means for causing flow of the first fluid into the conduit and a second pump means for causing flow of the second fluid into the conduit, the second pump means being provided on a fluid line located at the high pressure output side of the first pump means;

(f) providing a flow of the first fluid through the conduit and the beverage line to flush the solution from the beverage line.

Conveniently, the method of cleaning a beverage line in either of the above aspects may also comprise the step of providing a flow of the first fluid through the conduit, while preventing the second fluid from flowing through the orifice into the conduit, thereby flushing the solution from the conduit without flushing the beverage line.

Figure 1B:
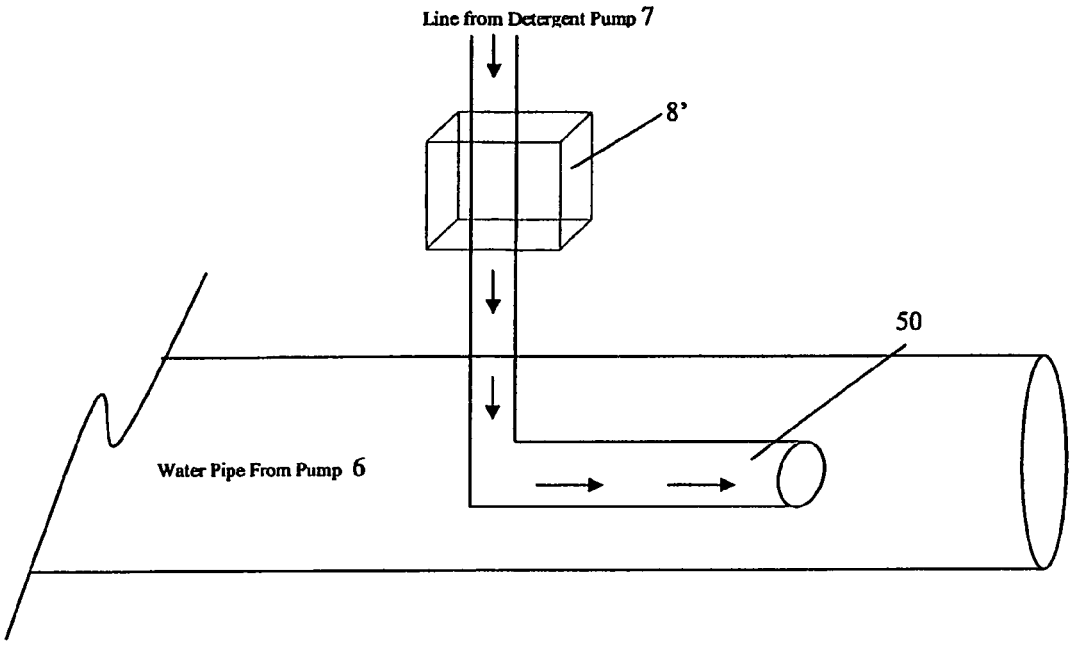
Figure 2:
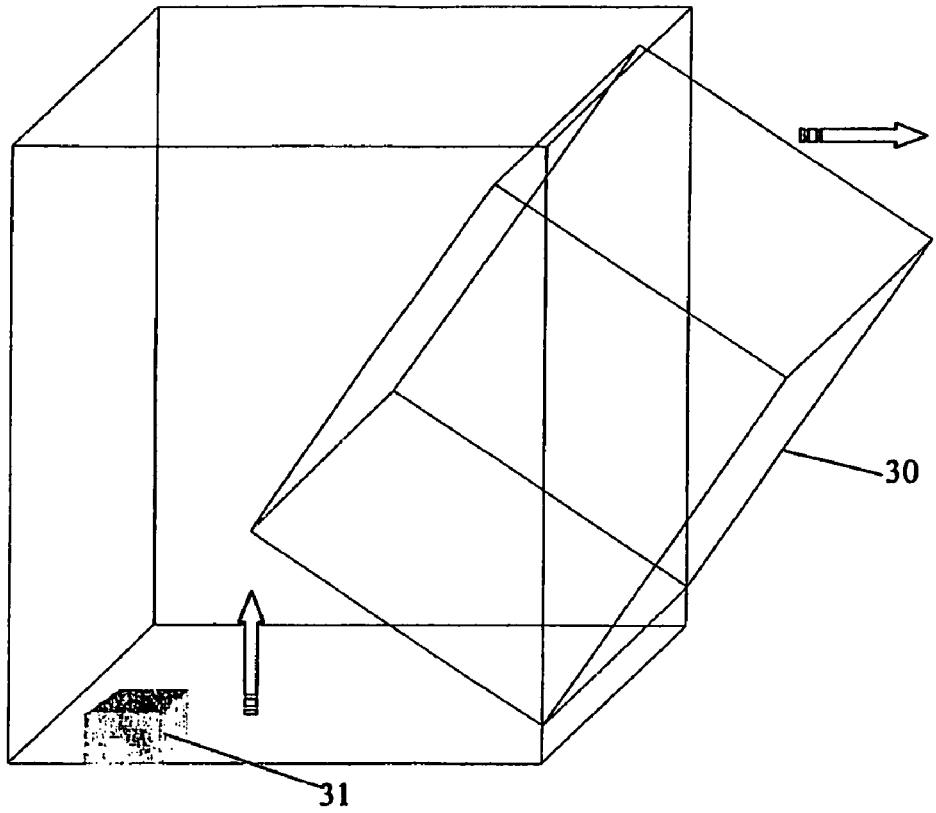
Figure 3:
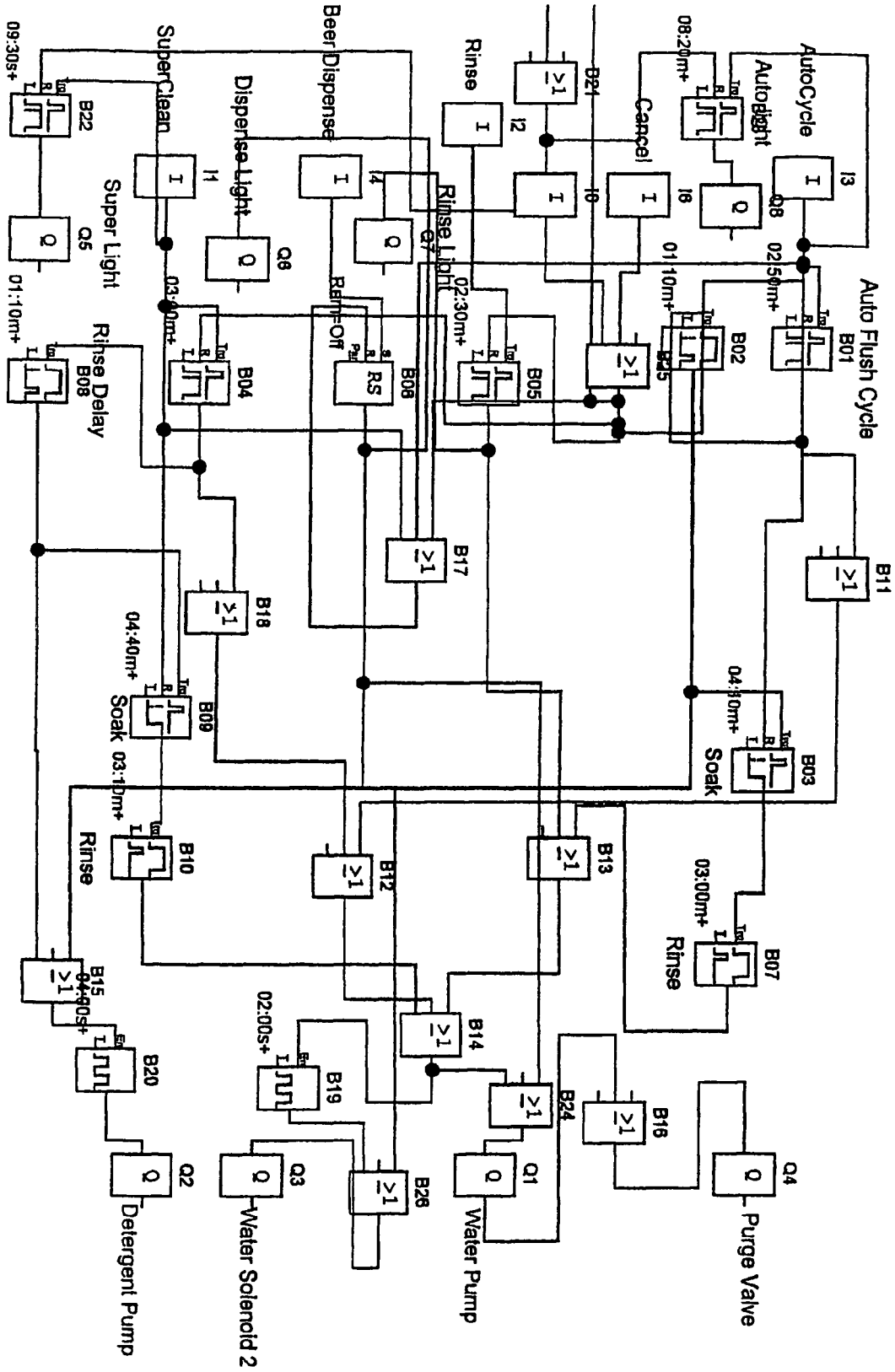

The apparatus and method of the invention will now be described more particularly with reference to the accompanying drawings, which show, by way of example only, one embodiment of the apparatus and method for cleaning beverage lines in accordance with the present invention. With respect to the drawings, the following is briefly noted:

FIG. 1*a* is a schematic diagram showing an apparatus of the invention;

FIG. 1*b* is a schematic diagram of a generally L-shaped cleaning fluid introduction device;

FIG. 2 is a schematic diagram of a tiltable detergent storage device including a cleaning fluid level sensor (weight sensor); and FIG. 3 is a schematic diagram of an apparatus according to the present invention as installed in a licensed premises.

Referring to the drawings and initially to FIG. 1*a*, the invention is referred to generally by reference numeral 100.

Except as described below, the apparatus shown in the drawings is installed in a cellar of a licensed premises.

The apparatus 100 for cleaning beverage lines comprises water tank 1 for storing water. The water tank 1 is connected through a pipeline (not shown) to the water main. Beer dispense lines (not shown) run from the cellar to main and subsidiary bars of the licensed premises.

Ring main 40 is connectable, intermediate its ends, to beer dispense lines. For this purpose, the ring main 40 is provided with connectors or sockets engagable with connectors or sockets at the ends of the dispense lines in the cellar. Each dispense line is provided with a respective valve (not shown) and, at its end in one of the bars, is provided with a dispense pump or tag.

The ring main 40 is also connected, at its end remote from the primary pump, to drain 28. The ring main 40 is also provided with purge valve 25.

Sensors and switches (described in detail below) are associated with the water tank 1 and a container of cleaning fluid, and with an operator interface in the cellar and in the main and subsidiary bars. All the sensors, switches and valves of the apparatus are interfaced with a sequential program of a programmable logic controller (PLC) provided on a control panel in the cellar. The control panel is provided with a keypad and a display, both connected to the PLC.

A cleaning or other program can be selected on the control panel, whereby the PLC causes the selected program to be run until a different program is selected. The desired cleaning program is selected with regard to build-up for different beers, and other factors.

The respective taps of barrels, casks or kegs (herein referred to generically as "kegs") of various beers in the cellar are connected to the dispense pumps in the bars via a respective connector or socket on each barrel and a corresponding connector or socket on each of the beer dispense lines.

The water tank 1 has a low level sensor 2 to ensure water supply and a high level overflow which is safely located away from any electrical parts. The water tank 1 is incorporated in the apparatus 100 so that the pump will not be subjected to any variations in the main water pressure which normally occur, and hence the apparatus 100 can deliver the water through the line at constant pressure regardless of the main water supply pressure. The water tank 1 contains ball cock 1*a* to ensure that the water drawn from the tank by the pump is replenished, and the sensor 2, which may be a float switch, is situated low in the tank 1 to indicate if there is a shortage of water for the cleaning cycle. This float switch 2 is connected in series with the start button on the control panel so that the float switch 2 must be closed for a circuit to be made when the start button is pressed; otherwise the cleaning cycle will not commence. If the float switch is open, an indicator light on the control panel will come on. These features protect the apparatus from running through a cleaning cycle either without cleaning fluid or without water.

Fitted to the bottom of the water tank 1 are two 24-V DC electrically operated solenoid valves 3, 3', which can be moved quickly between their respective open positions and closed positions. The solenoid valves 3, 3' are normally in the closed position when the beer lines are not being cleaned, and the solenoid valves 3, 3' return to the closed position if the electrical power supply is cut off for any reason.

The apparatus 100 also comprises stainless steel connection or food quality compliant pipes 4, 4' leading from the water tank 1 and connected to each solenoid valve 3, 3', respectively, to input chamber 5 of primary pump 6. The primary pump 6 comprises a 220-V centrifugal water pump. The cleaning fluid is introduced downstream of the primary pump 6 so as to avoid reaction of the cleaning fluid with the impeller of the primary pump 6 and reduction of operating effectiveness of the primary pump 6.

During operation, if only the first solenoid valve 3 is open, there is insufficient pressure, and the primary pump 6 becomes starved. A flow restriction is provided by the bore size of the pipe line 4 connecting the water tank 1, via the first solenoid valve 3 to the primary pump 6. The bore size of the pipe line 4 is such that it minimizes flow to the pump 6.

When the second solenoid valve 3' opens, the volume of water flowing to the pump 6 is doubled. The second solenoid valve 3' opens and closes repeatedly at a pre-determined rate, resulting in a pulsing motion of the water flowing in the ring main 40 and the beer lines connected thereto.

The apparatus 100 also includes secondary pump 7 consisting of a variable peristaltic pump which operates at 24-V DC. The secondary pump 7 incorporates polyvinyl chloride (PVC) or silicon tubing which is resistant to chemical degradation arising from contact with the cleaning fluid. The separate secondary peristaltic pump 7 is for feeding into the lines, the cleaning fluid from the cleaning fluid container which is held in cleaning fluid storage device 30. Whereas prior art apparatus use a venturi action to suck detergent in on the low pressure side of a primary pump, which has a problem that, if detergent is fed through the primary pump, pressure drops over time, the present invention overcomes this problem by introducing a cleaning fluid (detergent) on the high pressure side of the primary pump 6. The peristaltic pump 7 can control the rate of detergent delivery as the speed of the pump 7 can be changed.

Also included in the apparatus 100 are the following:

- non-return valves 8, 8' included after the cleaning fluid and main water have been mixed so as to avoid back-pressure during "soak" cycle;
- inline pressure switch 10 which regulates maximum working pressures and is also used for the beer dispense operation;
- two 220-V relays for pump switching;
- PLC unit to allow programming of features, timings and communication features;
- a touch screen information display device and control panel for communication with the PLC;
- a standard telecom 56*k* modem connected to the PLC or GSM adapter for wireless use;
- water ring main 40 which allows water and/or the cleaning solution to be pumped into the beer lines which are connected, in fluid communication, thereto;
- purge solenoid valve 25 which prevents cleaning solution build-up in the water ring main 40;
- cleaning fluid storage device 30 for holding and storing a container of cleaning fluid, the cleaning fluid storage device 30 including a tiltable panel which is pivotably movable relative to the base of the storage device 30, and also including level sensor 31 (weight sensor) for sensing the level of cleaning fluid in the container;
- line tagging system consisting of either "Reid" or RFDT system to allow line identification as part of reporting/logging capability;
- generally L-shaped cleaning fluid introduction device 50 made of stainless steel (shown in FIG. 1*b*); and
- drain 28;
- flow sensors 20, in the line to measure flow to allow mixing of acid, and also between connections on water main, as well as beer line connectors and Reid sensors 21; and pH gravity sensor 32 which identifies the cleaning fluid and controls the mix rate or cleaning cycle required so as to allow maximum flexibility for different cleaning requirements.

The apparatus of the invention will be available with two different types of control interface to allow cost reduction on a basic model for smaller licensed premises.

The main differences between the two types will be as follows:

- a PLC operated touch screen with information and selection of menus from a single device (modem included); and
- a standard push-button and light-indicator arrangement (which device will have the modem/communication device removed).

The main functions on both of these embodiments of the apparatus will be as follows:

- auto cycle;
- dispense;
- rinse;
- super clean; and
- cancel.

Indicators and warning/safety features include:

- power indicator;
- activity indicator;
- line blocked indicator; and
- detergent low indicator.

Safety features include:

- splash-proof removal/installation device 30 for the cleaning fluid;
- cleaning solution stored inside cabinet for further protection;
- drip-tray built into storage device 30 to prevent leakage;
- the main advantage of the storage device 30 being that of safety as a result of the cleaning fluid container no longer being stored exposed on a shelf where it was conveniently stored; when changing the container, the angle and tilt of the container ensures that the remaining detergent in the container is far away from the opening thereof, thereby preventing splashing;
- spring-loaded sensor (weight sensor) for detecting the level of cleaning fluid, the sensor being operable to prevent cycle activation when container level is low (FIG. 3);
- password-protected PLC setup to ensure correct timings and mix rates;
- front door locked to prevent tampering;
- solid modular design of case to ensure flexibility and longer operating reliability;
- full cancel and pause functionality; and
- flow-rate sensors combined with tag technology to ensure correct cleaning of individual lines.

Communication will be available through either a standard phone line or GSM mobile technology to facilitate reporting back to a centralized database.

The operation of the apparatus and method of the invention, in use, will now be described. The apparatus 100 has a number of cleaning options available. However, for the sake of clarity and to illustrate how the system works, the cleaning procedure for a typical keg beer setup will be described below.

The main unit is mounted on a wall in the cellar of a licensed premises and plumbed into a main water supply. A control panel provides a range of cleaning options. The apparatus 100 in the cellar is connected to a cleaning ring main 40. Beer lines to be cleaned are connected to the apparatus 100 via individual sockets on the ring main 40.

In operation, water from the holding tank 1 is rinsed through the lines being cleansed. The cleaning fluid is then automatically metered off from a container in the cleaning fluid storage device 30 and diluted with water to form a cleaning fluid solution. This solution is fed into the lines and left to soak. The lines are then rinsed through with water again. All waste is carried away through a drainage system installed under the bar counter of the licensed premises.

The operator decides which line or lines need to be cleaned. In the cellar, the operator turns off the product gas and any assist pump, if fitted. The operator then detaches the chosen beer line or lines from the keg and connects the beer line or lines to the cleaning ring main 40 line.

The "DISPENSE" button on the control panel of the apparatus 100 is then pressed by the operator, and the fob float is released. The fob is bled until full of liquid. Any remaining beer in the line can be sold. The apparatus 100 will push the beer through the line using water instead of gas.

When the beer has been sold off, the cleaning program can then be started.

In the bar, the operator simply attaches the drainage system of the apparatus 100 to the appropriate beer taps.

The operator presses the "AUTO CYCLE" button on the control panel located in the bar area of the licensed premises, and the cleaning cycle commences. Firstly, the beer line is flushed through with water.

The vigorous cleaning effect created by the pulsing action generated by cyclical opening and closing of the second solenoid valve 3' dislodges build-up of yeast in the lines. The apparatus 100 accurately mixes water and detergent and feeds it into the line.

The "soak" period will then be electronically timed. After the "soak" period, the apparatus 100 flushes the line through with water again. During the final rinse, a purge unit in the cellar opens, causing the rinse water to flush through the ring main 40 removing any residual cleaning fluid. When the program is complete, a light will flash on the control module accompanied by an audible indicator. The chosen line or lines have now been cleaned with minimal beer loss and with minimal operator involvement, and it or they are now ready for use.

The apparatus of the invention may also optionally include a "dongle" device (not shown) provided for attachment to the beer line connectors 21 on the ring main 40. Commonly, gas lines, which provide the gas used to pressurize the beer dispense lines, run parallel to the beer dispense lines. As the beer line connectors 21 are also connected across the parallel gas lines, the "dongle" device is provided to enable communication between the beer dispense lines and the gas lines. The "dongle" device comprises an electrically operated solenoid valve which, when in an open position, allows gas from the gas lines to flow into the beer dispense lines connected to the main ring 40. The advantage of the device is that it ensures a complete flushing of the beer dispense lines after cleaning. It is envisaged to use the device where the beer lines being cleaned are only occasionally used, for example, in temporary bars, where any excess liquid remaining in the lines over a period of time after flushing is wholly unacceptable.

It will of course be understood that the invention is not limited to the specific details described herein and that various modifications and alterations are possible without departing from the scope of the invention as defined in the appended claims.

What is claimed is:

1. A beverage line cleaning apparatus comprising:

(a) a conduit for connecting the beverage line in fluid communication with a supply of a first fluid; and a connector means for connecting the beverage line to the conduit;

(b) at least one orifice opening in the conduit for connection via a fluid line to a supply of a second fluid;

(c) pump means operable to allow the second fluid to enter the conduit in a predetermined proportion relative to the first fluid;

(d) means for closing a connection between the orifice in the conduit and the supply of the second fluid; and (e) a primary first fluid control means and a secondary first fluid control means, operable for controlling the flow of the first fluid into the conduit, the primary and secondary first fluid control means being selectively and independently movable between respective open positions in which the first fluid can flow into the conduit and respective closed positions in which flow of the first fluid into the conduit is prevented, characterized in that the apparatus comprises means for creating a pulsed secondary flow of first fluid into the conduit, said means for creating a pulsed secondary flow of first fluid into the conduit comprising means for selectively moving the secondary first fluid control means alternately between the open position and the closed position, with the primary first fluid control means in the open position providing a primary flow of first fluid, wherein said pump means is a second pump means for causing flow of the second fluid into the conduit, and the apparatus further comprises a first pump means for causing flow of the first fluid into the conduit, the second pump means being provided on a fluid line located at a high pressure output side of the first pump means such that the second fluid can be introduced into the first fluid on the high pressure side of the first pump means.

2. The apparatus of claim 1, wherein the primary and secondary first fluid control means respectively comprise first and second solenoid valves.

3. The apparatus of claim 2, wherein said pump means is a second pump means for causing flow of the second fluid into the conduit, and the apparatus further comprises a first pump means for causing flow of the first fluid into the conduit, the second pump means being provided on a fluid line located at a high pressure output side of the first pump means.

4. A beverage line cleaning apparatus comprising:

(a) a conduit for connecting the beverage line in fluid communication with a supply of a first fluid; and a connector means for connecting the beverage line to the conduit;

(b) at least one orifice opening in the conduit for connection via a fluid line to a supply of a second fluid;

(c) pump means operable to allow the second fluid to enter the conduit in a predetermined proportion relative to the first fluid;

(d) means for closing a connection between the orifice in the conduit and the supply of the second fluid; and (e) a first pump means for causing flow of the first fluid into the conduit, and a second pump means for causing flow of the second fluid into the conduit, the second pump means being provided on a fluid line located at a high pressure output side of the first pump means such that the second fluid can be introduced into the first fluid on the high pressure side of the first pump means.

5. The apparatus of claim 4, further comprising a primary first fluid control means and a secondary first fluid control means, operable for controlling flow of the first fluid into the conduit, the primary and secondary first fluid control means being selectively and independently movable between respective open positions in which the first fluid can flow into the conduit and respective closed positions in which flow of the first fluid into the conduit is prevented, and characterized in that the apparatus comprises means for creating a pulsed secondary flow of the first fluid into the conduit, said means for creating a pulsed secondary flow of the first fluid into the conduit comprising means for selectively moving the secondary first fluid control means alternately between the open position and the closed position, with the primary first fluid control means in the open position providing a primary flow of the first fluid.

6. The apparatus of claim 4, wherein the first fluid and second fluid are both liquid; the first fluid is water, and the second fluid is a cleaning agent in liquid form.

7. The apparatus of claim 4, wherein the first pump means for causing flow of the first fluid comprises a primary pump for pumping the first fluid from a water supply into the conduit, and the second pump means for causing flow of the second fluid comprises a secondary pump which is a peristaltic pump.

8. The apparatus of claim 4, wherein the conduit is a ring main.

9. The apparatus of claim 4, wherein the means for closing a connection between the orifice in the conduit and the supply of the second fluid comprises a non-return valve provided on the fluid line connecting the conduit to the supply of the second fluid.

10. The apparatus of claim 4, further comprising means for opening and closing a connection between the conduit and the beverage line thereby enabling the conduit to be flushed by the first fluid, free of the second fluid, selectively with or without the first fluid flushing the beverage line.

11. The apparatus of claim 4, which includes a generally L-shaped cleaning fluid introduction device which allows introduction of the cleaning fluid at both the input to the main pump as well as the output of the primary pump where there is high pressure on the line.

12. The apparatus of claim 4, which includes a fully configurable reporting system with a built-in modem for use with conventional telephone lines or GSM mobile systems.

13. The apparatus of claim 4, further comprising a "tag" identification system which can exclude pre-determined beverage lines to be washed and also report remotely to a central resource on cleaning progress and frequency of cleaning.

14. The apparatus of claim 4, which includes a pH gravity flow meter which identifies detergent and controls mix rate or cleaning cycle required so as to allow maximum flexibility for different cleaning requirements.

15. The apparatus of claim 4, further comprising a tillable cleaning fluid storage device.

16. The apparatus of claim 4, wherein the cleaning fluid storage device includes a spring-loaded level indicator to prevent operation of the apparatus if the container of cleaning agent is empty or the level is too low.

* * * * *